US005240212A

United States Patent [19]

Brodie

[11] Patent Number: 5,240,212

[45] Date of Patent: Aug. 31, 1993

[54] TOILET SEAT HOLDER

[76] Inventor: Frank Brodie, 8 Shadywood Road, Brampton, Ontario, Canada, L6Z 4E2

[21] Appl. No.: 807,264

[22] Filed: Dec. 13, 1991

[51] Int. Cl.[5] ..... A47K 13/24

[52] U.S. Cl. ..... 248/214; 248/225.31; 4/661

[58] Field of Search ..... 248/214, 215, 217.1, 248/225.31, 229, 230, 231, 316.1, 910; 4/661, 253, 251.2, 252.1; D23/311, 312, 313

[56] References Cited

U.S. PATENT DOCUMENTS

| | | | |
|---|---|---|---|
| D. 245,095 | 7/1977 | Murray | D23/311 X |
| 560,465 | 5/1896 | Bostwick | 248/459 X |
| 903,596 | 11/1908 | Martin et al. . | |
| 2,302,300 | 11/1942 | Davies | 224/42.45 R |
| 2,487,645 | 11/1949 | Gershon | 248/214 X |
| 2,920,853 | 1/1960 | Bufogle | 248/214 |
| 3,578,282 | 5/1971 | Olsen | 248/214 |
| 4,145,771 | 3/1979 | Khazin | 4/253 |
| 4,577,350 | 3/1986 | Clark | 4/251 |
| 4,638,515 | 1/1987 | Caputo et al. | 4/661 |
| 4,651,358 | 3/1987 | Logan, Jr. | 4/253 |
| 4,707,870 | 11/1987 | Glassco et al. | 4/661 |
| 4,805,246 | 2/1989 | De Vargas et al. | 4/253 |
| 4,839,928 | 6/1989 | Probasco | 4/251 |
| 4,967,426 | 11/1990 | Williams, Sr. | 4/661 |
| 5,052,061 | 10/1991 | Nichols | 4/661 |

*Primary Examiner*—Alvin C. Chin-Shue
*Assistant Examiner*—Korie H. Chan
*Attorney, Agent, or Firm*—Krass & Young

[57] ABSTRACT

A toilet seat and lid holder is disclosed for holding a toilet lid and toilet seat in the upright position against the toilet tank of the toilet. The holder includes a securing bracket for releasably connecting the holder to the toilet tank. In one embodiment, the holder securing bracket is a U-shaped bracket which fits over the upper edge of the toilet tank under the toilet tank cover. An L-shaped arm is connected to the bracket and has a portion which extends vertically upwards away from the bracket. An elongate flexible connector is connected at one end to the end of the L-shaped arm spaced from the bracket. A weight is attached at the other end of the flexible connector and which hangs down over the toilet seat and cover being held down by gravity thereby holding the toilet seat and cover against the toilet tank in the upright position.

11 Claims, 6 Drawing Sheets

TOILET SEAT HOLDER

FIELD OF THE INVENTION

The subject invention relates to a device for holding a toilet seat and cover in the upright position.

BACKGROUND OF INVENTION

Many types of toilet seat arrangements require a way of retaining the seat and cover in the vertically upright position. One example of such an arrangement is a toilet seat fabricated from thick foam. In this case, when the seat is raised and resting against the toilet seat cover, which in turn is resting against the toilet tank, the thickness of the seat results in the latter forming an angle less than or equal to ninety degrees with the horizontal so that it remains in an unbalanced state, whereby it may readily drop down to the horizontal position.

Various prior art devices are known for retaining toilet seats and toilet covers in the upright position. Generally, these devices include a bracket which fits over the top edge of the toilet tank and a rigid retaining member pivotally connected to the bracket which swings into engagement with the seat and cover thereby holding same against the toilet tank in the upright position.

A drawback to these types of devices are that they take up a lot of room, which makes them inconvenient to use, particularly when the toilet is in cramped quarters. Also, by being rigid, they have a fixed length and therefore being non-adjustable may not be useable, if for example, a thicker toilet seat was used to replace a thinner seat.

SUMMARY OF THE INVENTION

The subject invention provides a toilet seat holder for releasably maintaining a toilet seat and cover in the upright position.

In one aspect of the invention, the holder includes a securing means for securing the holder to a portion of the toilet located behind the toilet seat. The securing mechanism includes a bracket adapted to fit over an upper edge of the toilet tank and an arm portion attached to the bracket so that when the bracket fits over the upper edge, an elongate section of the arm extends vertically upwards from the upper edge. An elongate, flexible and bendable connector having two opposed ends is connected at a first end to an end section of the arm portion while a weight member is connected to the second end of the flexible connector. When the toilet seat and cover are in the generally vertical upright position, the weight member hangs down loosely in front of the toilet seat and cover thereby, the weight of the weight member being sufficient to hold the seat and cover against the back portion of the toilet. The weight member 26 has a weight sufficient to hold the seat generally upright and to overcome any tendency for the seat to fall down to a horizontal position.

BRIEF DESCRIPTION OF THE DRAWINGS

The toilet seat restraining apparatus or holder of the subject invention will now be described, by way of example only, with reference to the accompanying drawings, in which.

DETAILED DESCRIPTION OF PREFERRED AND ALTERNATIVE EMBODIMENTS OF THE INVENTION

Figure 1:
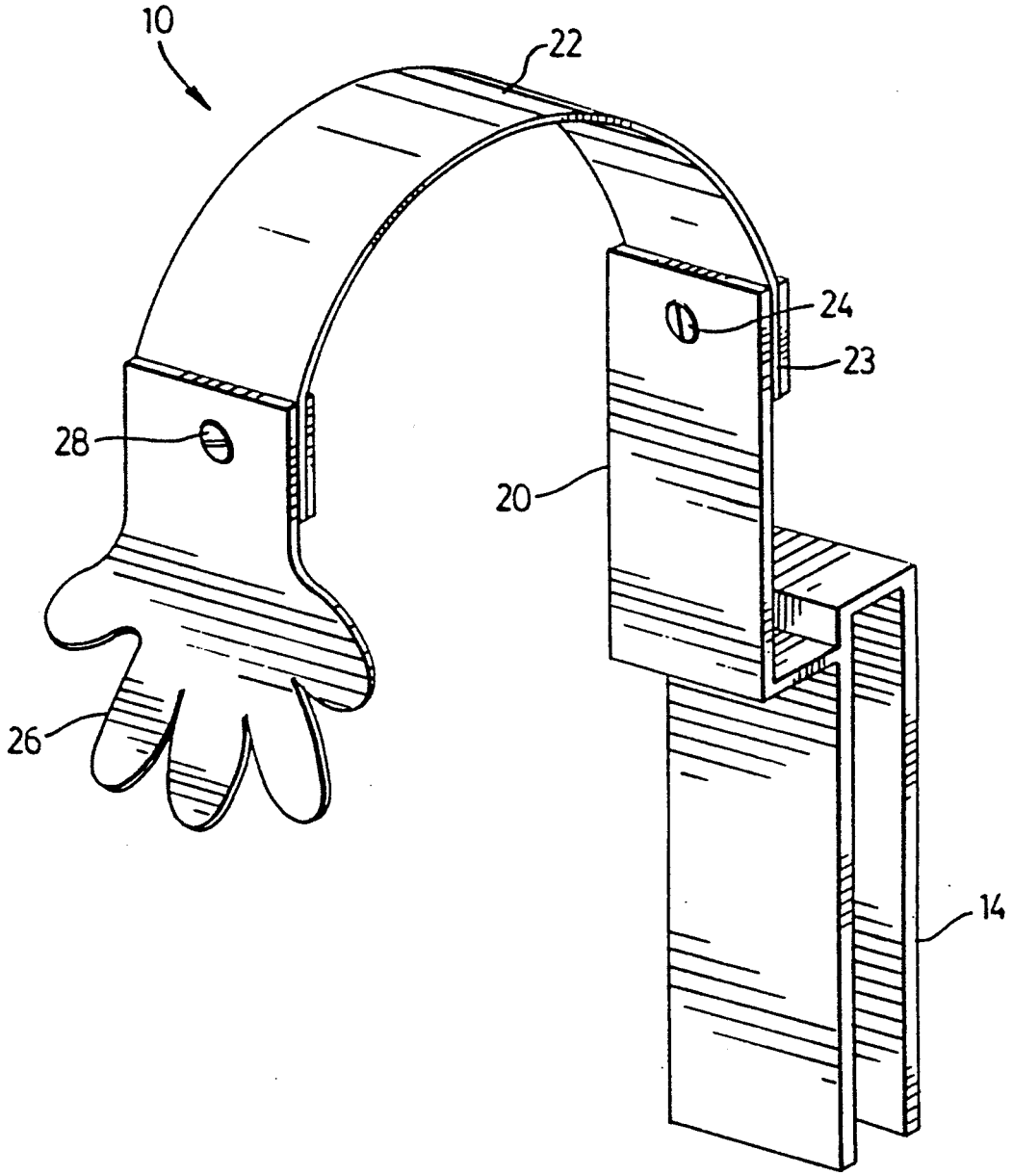
FIG. 1 is a perspective view of an embodiment of the toilet seat holder of FIG. 1.
Figure 2:
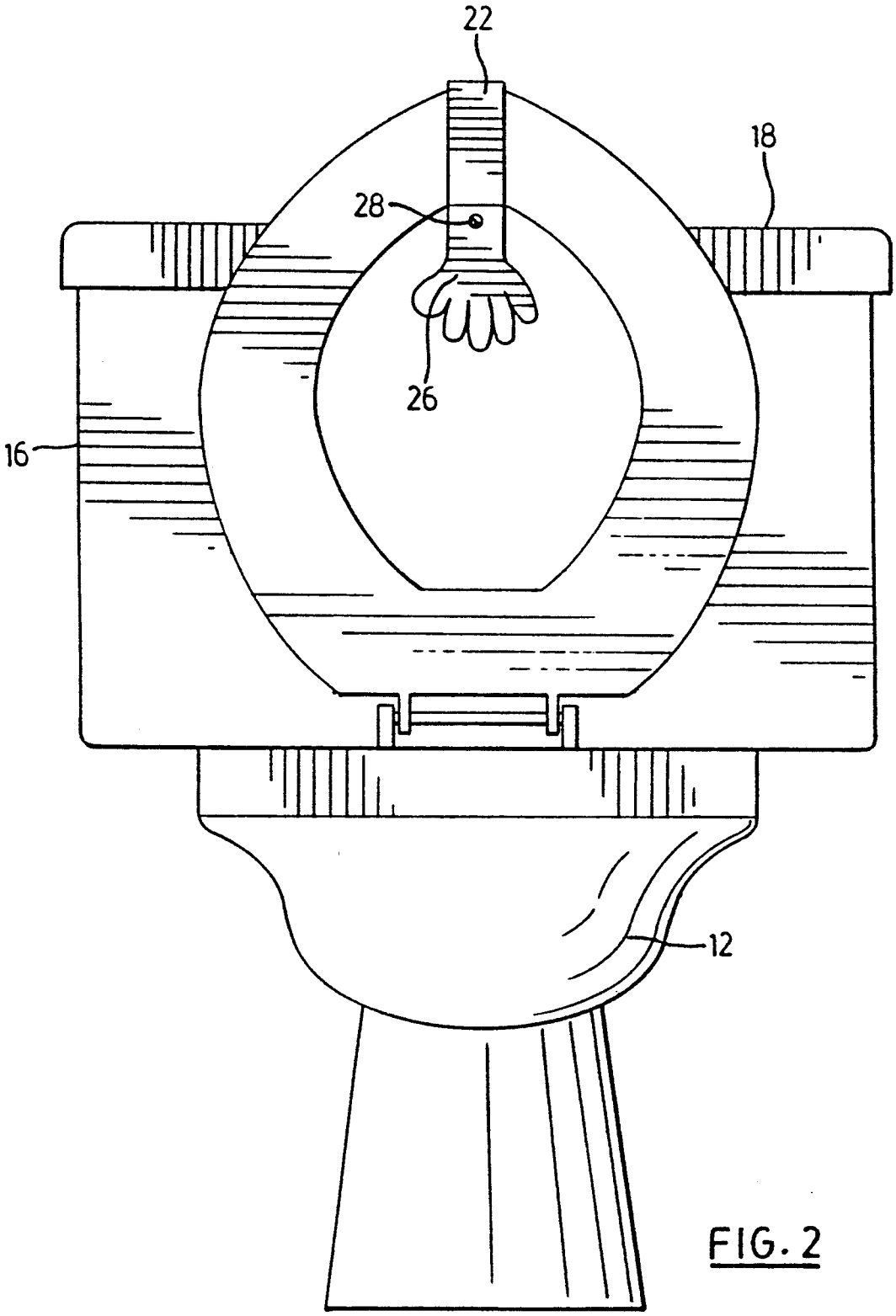
FIG. 2 is a front elevational view of a toilet and toilet seat holder apparatus of the subject invention.
Figure 3:
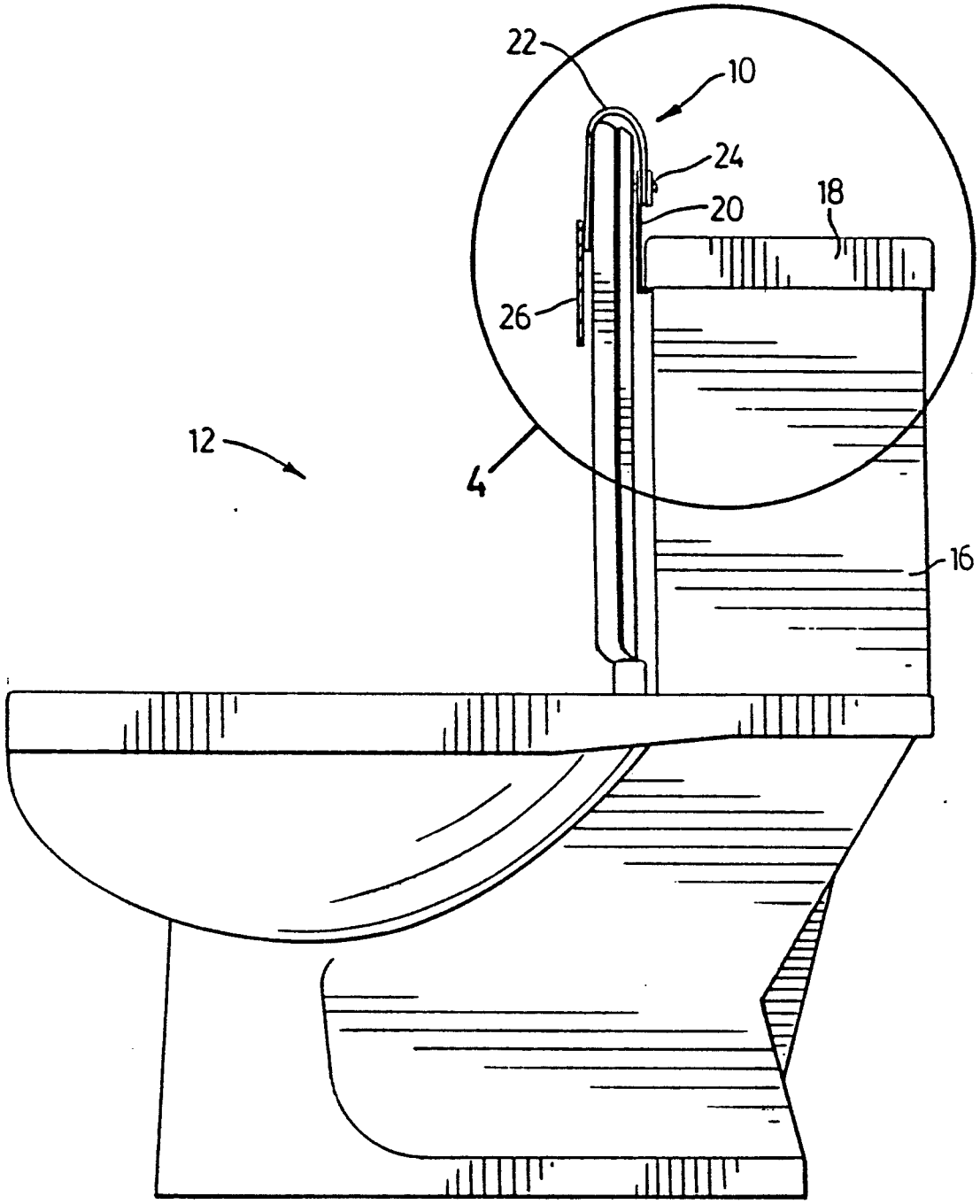
FIG. 3 is an elevational side view of the toilet and toilet seat holder of FIG. 2.
Figure 4:
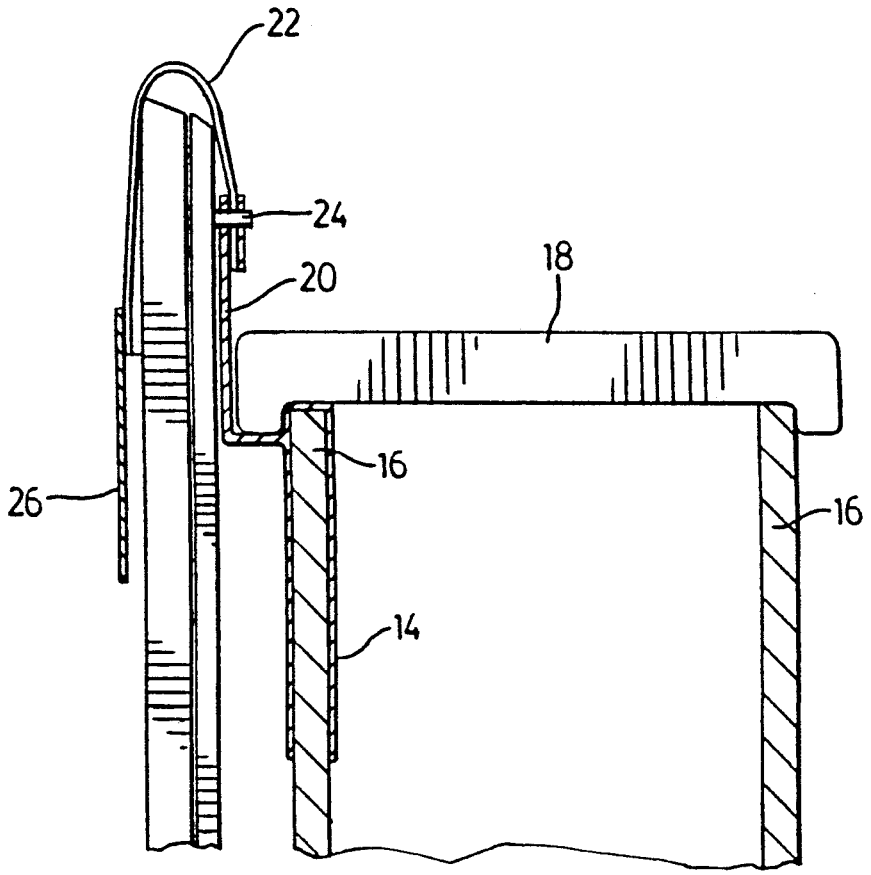
FIG. 4 is a sectional side view, partly broken away, of the encircled portion of FIG. 3.

Referring to FIG. 1, a toilet seat and cover holder apparatus is shown in perspective at 10. FIGS. 2–4 illustrate the toilet seat holder coupled to a toilet shown generally at 12. Holder 10 comprises a rectangular U-shaped securing member or bracket 14 which is dimensioned to fit over the upper edge of a standard toilet tank such as is shown at 16. Bracket 14 is readily connected to tank 16 by removing tank lid 18, placing bracket 14 over the edge of tank 16 and replacing lid 18.

An L-shaped arm 20 is secured at one end to bracket 14 with the other end extending vertically upwards and spaced from the side edge of tank lid 18. Bracket 14 and arm 20 are preferably fabricated from plastic and integrally formed as one piece.

A flexible and bendable connector member 22 is secured at one end to arm 20 at 23, spaced from bracket 14, by any one of several known ways, including nut and bolt as shown at 24, rivets, and epoxy, just to mention a few. Connector 22 is preferably fabricated from an elongate, flexible and bendable strap-like material such as rubber, flexible plastic or heavy gauge cloth, and is long enough to be utilized with any toilet seat and cover of reasonable thickness. However, as long as member 22 is flexible, almost any material is suitable.

Figure 6:
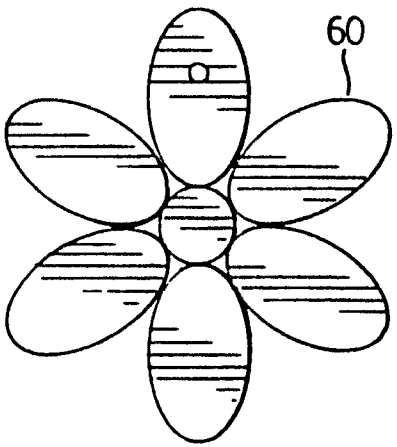
FIGS. 5 and 6 illustrate two alternative embodiments of the generally flat weight members used in the toilet seat holder of the present invention.
Figure 5:
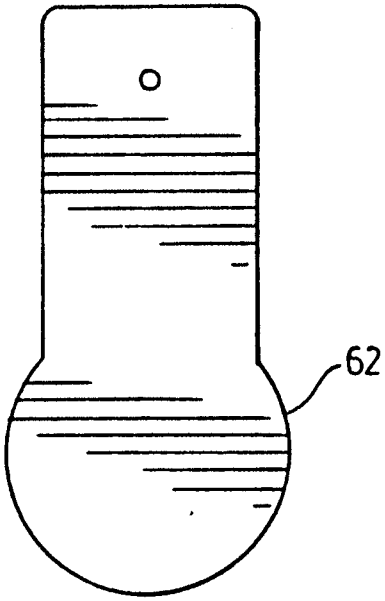
Figure 7:
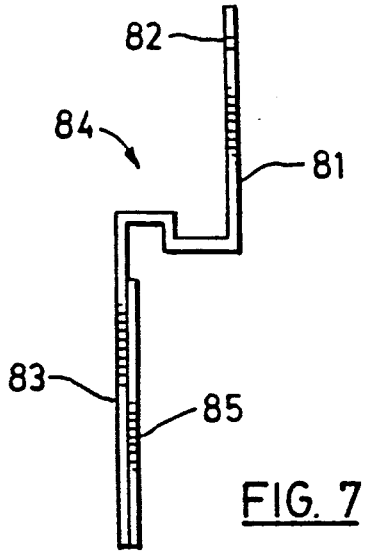
FIGS. 7 to 11 illustrate several alternative embodiments of the securing means for securing the toilet seat holder to the toilet tank.

Holder 10 includes a weight member 26 connected to the other end of connector 22 using any one of several securing techniques such as nut and bolt as shown at 28, or with adhesives, rivets and the like. The weight member may take the form of an aethsetically pleasing object, such as a hand 26 as seen in FIGS. 1 and 2, or a flower 60, see FIG. 6. Alternatively, a heavy, flat plate 62, FIG. 6, may also serve as a weight member. The weight member 26 has a weight sufficient to hold the seat generally upright and to overcome any tendency for the seat to fall down to a horizontal position.

Referring to FIGS. 7 to 11, alternative embodiments of the toilet seat and cover holder securing member are illustrated. Securing member 84 shown in FIG. 7 includes an adhesive 85 attached to vertical member 83 which attaches to the inside wall of the toilet tank. A flexible connector (not shown) is connected to arm 81 at hole 82.

Figure 8:
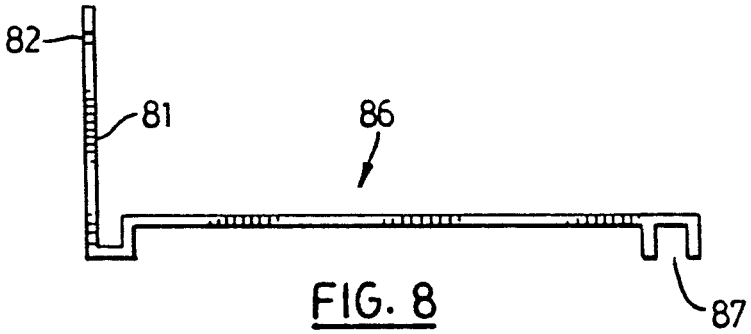
Figure 9:
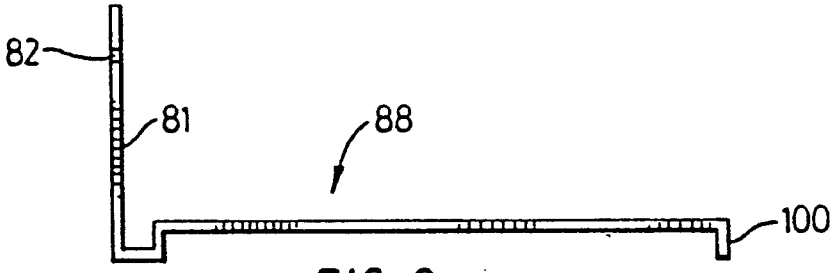

Securing member 86 shown in FIG. 8 extends across the top of the toilet tank under the tank lid with bracket 87 extending about the back, upper edge of the toilet tank. Securing member 88, shown in FIG. 9, is similar to member 86 except that it has only an end flange 100 at the end opposite the arm 81. This flange extends downwardly at the rear of the upper edge.

Figure 10:
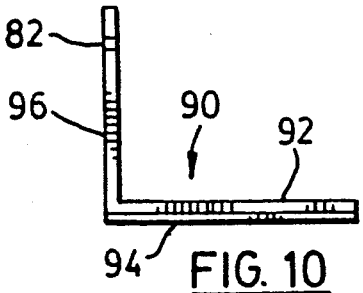
Figure 11:
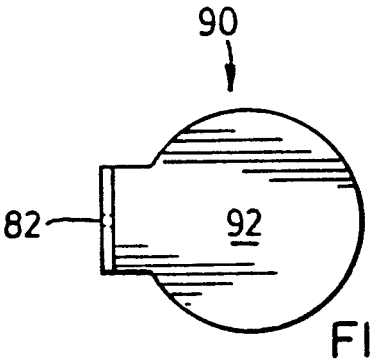

Securing member 90, shown in FIGS. 10 and 11, includes a planar, circular portion 92 having an adhesive 94 applied to the bottom surface thereof. Member 90 is secured to the top surface of the toilet tank (usually the lid of the tank) and the flexible connector (not shown) is connected to vertical arm 96 at the hole 82.

It will be appreciated that the flexible connector member 22 provides for a compact and convenient restraining apparatus, which can be stored by resting the weight member 26 on the top of tank lid 18 or letting it hang down the front of tank 16 or hanging it down the back of tank 16.

While the present invention has been described and illustrated with respect to the preferred and alternative embodiments, it will be appreciated that numerous variations of these embodiments may be made without departing from the scope of the invention, which is defined in the appended claims.

I claim:

1. A toilet seat holder for releasably maintaining a toilet seat in a generally vertical upright position against a toilet tank which is located substantially behind the toilet seat, comprising:

a) securing means for securing said holder to said toilet tank, said securing means including a bracket adapted to fit over an upper edge of said toilet tank and an arm portion attached to said bracket so that when said bracket fits over said upper edge, an elongate section of said arm portion extends substantially vertically upwards from said upper edge;

b) a flexible and bendable connector member having first and second opposed ends, the first end attached to an end section of the arm portion spaced from the bracket; and c) a weight member attached to said second end of said connector member, wherein said securing means is attachable to said tank portion of said toilet and when said seat is in the generally vertical position, said connector can extend over the top of said seat to permit said weight member to hang down loosely in front of said seat, the weight of said weight member being sufficient to hold said seat generally upright and to overcome any tendency for said seat to fall down to a horizontal position.

2. A toilet seat holder according to claim 1 wherein the bracket is U-shaped and said arm portion is L-shaped and attached to said bracket at a position adjacent to a closed end of said bracket.

3. A holder according to claim 1 wherein the connector member is a flexible strap fabricated from rubber or plastic material.

4. A holder according to claim 1 wherein the connector member is a flexible strap fabricated from cloth.

5. A holder according to claim 2 wherein the connector member is a flexible strap fabricated from rubber or plastic rubberlike material.

6. A holder according to claim 1 wherein said weight member is substantially flat and has a decorative shape.

7. A holder according to claim 1 wherein said weight member is substantially flat and has the shape of a human hand.

8. A holder according to claim 1 wherein said weight member is substantially flat and has the shape of a flower.

9. A toilet seat holder for releasably maintaining a toilet seat in a generally vertical upright position against a toilet tank which is located substantially behind the toilet seat, comprising:

a) securing means for securing said holder to said toilet tank, said securing means including a U-shaped bracket adapted to fit over an upper edge of said toilet tank and an L-shaped arm portion attached to said bracket at a position adjacent a closed end of said bracket so that when the bracket fits over said upper edge, and elongate portion of said arm extends substantially vertically upwards from said U-shaped bracket;

b) a flexible connector member in the form of a flexible strip fabricated from cloth and having first and second opposed ends, the first end attached to an end portion of said arm portion spaced from the bracket; and c) a weight member attached to said second end of said connector member, wherein said securing means is attachable to said tank portion of said toilet and when said seat is in the generally vertical position, said connector can extend over the top of said seat to permit said weight member to hang down in front of said seat, the weight of said weight member being sufficient to hold said seat generally upright and to overcome any tendency for said seat to fall down to a horizontal position.

10. A holder according to claim 9 wherein said weight member is substantially flat and has a decorative shape.

11. A holder according to claim 9 wherein said U-shaped bracket and said arm portion are fabricated from plastic and integrally formed as one piece.

* * * * *